United States Patent [19]

Matsumoto et al.

[11] Patent Number: 4,803,593

[45] Date of Patent: Feb. 7, 1989

[54] FLAT SOLID DISCHARGING DEVICE

[75] Inventors: Kazuyoshi Matsumoto, Tokyo; Seiichi Miyakawa, Nagareyama; Eishu Ohdake; Shigeru Suzuki, both of Yokohama, all of Japan

[73] Assignee: Ricoh Company, Ltd., Tokyo, Japan

[21] Appl. No.: 105,610

[22] Filed: Oct. 8, 1987

[30] Foreign Application Priority Data

Oct. 14, 1986 [JP] Japan ..... 61-156138[U]
Oct. 28, 1986 [JP] Japan ..... 61-254602

[51] Int. Cl.[4] ..... G03G 15/02; H01T 19/00

[52] U.S. Cl. ..... 361/225; 361/230; 250/326; 355/3 CH

[58] Field of Search ..... 355/3 CH, 14 CH; 250/234–236; 361/213, 225, 230, 229; 346/159

[56] References Cited

U.S. PATENT DOCUMENTS 4,263,636 4/1981 Testone ..... 361/213 X
4,409,604 11/1983 Fotland ..... 346/159
4,652,318 3/1987 Masuda ..... 250/324 X

FOREIGN PATENT DOCUMENTS 58-48075 3/1983 Japan ..... 355/3 CH
60-181763 9/1985 Japan ..... 355/3 CH
60-192969 10/1985 Japan ..... 355/3 CH
61-17164 1/1986 Japan ..... 355/3 CH
61-83559 4/1986 Japan ..... 355/3 CH
61-151570 7/1986 Japan ..... 355/3 CH

*Primary Examiner*—Arthur T. Grimley
*Assistant Examiner*—J. Pendegrass
*Attorney, Agent, or Firm*—Oblon, Fisher, Spivak, McClelland & Maier

[57] ABSTRACT

A flat solid discharging device applicable to an electrophotographic copier, facsimile apparatus and other electrostatic recording apparatuses for charging or discharging a photoconductive element. The device includes a dielectric element, a first and a second electrode juxtaposed to each other through the dielectric element, and a power source for applying an ac voltage across the first and second electrode to produce ions in the vicinity of the two electrodes. The first electrode has a hairline configuration and extends along the length of the device. The second electrode is constituted by a plurality of comblike conductive strips each of which extends crosswise relative to the first electrode through the dielectric. By adequately selecting the pitch of the conductive strips and the distance between the second electrode and the photoconductive element, irregularity in charging which corresponds to the pitch of the conductive strips is made negligible. The second electrode is divided into a plurality of segments in order to selectively charge the photoconductive element over different charging areas as desired.

11 Claims, 4 Drawing Sheets

FLAT SOLID DISCHARGING DEVICE

BACKGROUND OF THE INVENTION

The present invention relates to a flat solid discharging device which may be installed in an electrophotographic copier, facsimile apparatus and other electrostatic recording apparatuses to serve as a charger or a discharger as desired.

A current trend in the electrostatic recording art is toward the use of a flat solid discharging device which may replace the traditional hairline type corona discharger. A flat solid ischarging device includse a first electrode and a second electorde which is constituted by a single flat conductive member. In the case that such a discharging device is installed in, for example, an electrophotographic copier to serve as a charger, it naturally has to uniformly charge the surface of a photoconductive element before the latter is exposed imagewise.

A problem with a prior art flat solid discharging device is that the discharge by the device is not even in the lengthwise direction, i.e., the charge deposited on teh photoconductive element is not uniform due to irregular capacitance distribution between the first and second electrodes as well as to non-uniform end configurations and material of the first electrode. Especially, when the ac voltage applied across the first and second electrodes is approximately as low as a discharge start voltage, it is difficult for the discharge to occur uniformly and, therefore, for the photoconductive element to be uniformly charged. While uniform discharge maybe achieved by increasing the ac voltage applied across the first and second electrodes, such would produce a prohovitive amount of ozone to damage the electrodes and/or to deteriorate the dielectric surfaces.

In the event when the photoconductive element is charged before exposure, should it be needlessly charged in its area other than an expected paper sheet area, toner particles not transferred to a paper sheet would remain on the photoconductive element to invite waste of toner, or developer, and an increase in the load of cleaning the remaining toner. In the light of this, various methods have heretofore been proposed for changing the charging range of a discharging device in such a manner as to match it to a particular paper sheet size. One of such methods consists in dividing the second electrode into a plurality of segments according to the sizes of paper sheets, and applying an ac voltage on a segment basis. Another method known in the art consists in using a plurality of first electrodes each of which is associated with a different paper sheet size, and selectively connecting the first electrodes to a power source based on a charging area on the photoconductive element. A drawback particular to the first-mentioned method is that the second electrodes have to be provided in a stepwise configuration in order to eliminate irregular charging otherwise caused at their junctions and, in addition, uniform charging is unattainable unless a plurality of first electrodes are used. The second-mentioned method, too, has a shortcoming that a plurality of first electrodes have to be used. Moreover, neither the first method nor the second method gives consideration to the load which acts on the power source at the instant of changeover of the electrodes. Specifically, when the electrodes are simply selectively connected to the power source, the discharge condition is changed to prevent a predetermined charge potential from being provided on the photoconductive element.

SUMMARY OF THE INVENTION

It is, therefore, an object of the present invention to provide a flat solid discharging device capable of uniformly charging or discharging a desired object even if the voltage applied thereto is low.

It is another object of the present invention to provide a flat solid discharging device capable of selecting a desired area of an object to change and charging or discharging the selected area only.

It is another object of the present invention to provide a generally improved flat solid discharging device.

A flat solid discharging device of the present invention comprises a dielectric substrate, a hairline type first electrode extending along the length of the discharging device, a second electrode located to face the first electrode through the dielectric substrate, and an ac applying means for applying an ac across the first and second electrodes to produce ions in the vicinity of the first electrode. The second electrode comprises a plurality of comblike conductive strips each extending crosswise relative to the first electrode through the dielectric substrate.

The above and other objects, features and advantages of the present invention will become more apparent from the following detailed description taken with the accompanying drawings.

DESCRIPTION OF THE PREFERRED EMBODIMENTS

Figure 1:
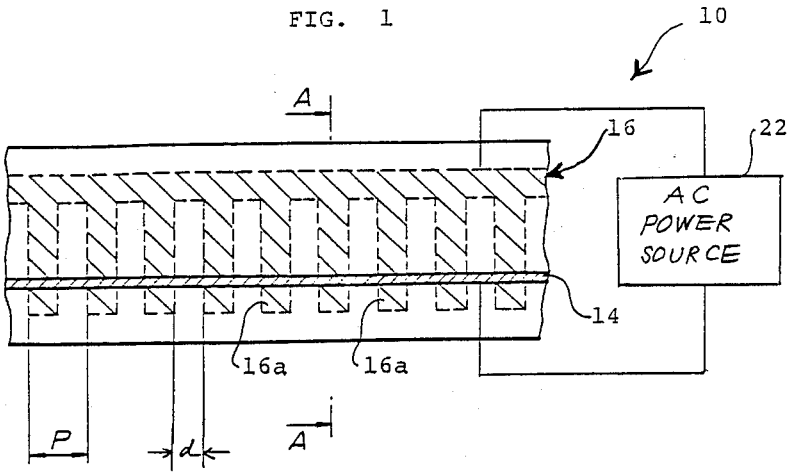
FIG. 1 is a plan view of a flat solid discharging device embodying the present invention.
Figure 2:
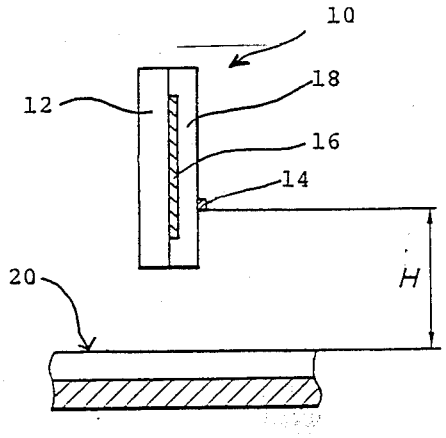
FIG. 2 is a section along line A—A of FIG. 1, showing a positional relationship between the discharging device and an object to be charged.

Referring to FIGS. 1 and 2 of the drawings, a discharging device embodying the present invention is shown and generally designated by the reference numeral 10. As shown, the discharging device 10 is made up of a substrate 12 made of an insulator, a first electrode 14, a second electrode 16, and a substrate 18 made of a dielectric. As shown in FIG. 2, the second electrode 16 comprises a plurality of conductive strips **16*a* hich are arranged in a comblike configuration, each conductive strip 16*a* extend across the first electrode 14. The conductive strip 16*a* are positioned at the same pitche, P in FIG. 1, and electrically connected to each other. Each of the first and second electrodes 14 and 16 is formed on a respective one of opposite surfaces of the dielectric substrate 18. The discharging device 10 is positioned upright relative to an object 20** to be charged, e.g. a photoconductive element of a copier.

In operation, an ac voltage from a power source 22 is applied across the first and second electrodes 14 and 16 to generate positive and negative ions in the vicinity of the first electrode 14. A bias voltage is applied across the first electrode or second electrode 16 and the photoconductive element 20 so as to charge the latter to a predetermined polarity. The bias voltage may be replaced with a rectified version of a part of or the whole ac voltage, if desired. Further, in the case that the device 10 is used as a discharger, it would suffice to apply an ac voltage or to apply a low bias voltage.

In FIG. 2, should the distance H between the photoconductive element 20 and the first electrode 14 be short, the charging or discharging would become nonuniform according to the pitch P of the second electrode 16. Uniform charging or discharging is attainable if the distance H is increased. For experiment, the device 10 was used as a charger with the thickness of the dielectric substrate 18 selected to be 0.2 millimeter and with the pitch P of the second electrode 16 selected to be 1 millimeter. The experiment showed that, if the distance H is greater than 6 millimeters, uniform charging is achievable with no trace of discharge which would otherwise occur according to the pitch P. When the dielectric substrate 18 was 1.0 millimeter thick and the pitch P was 1 millimeter, uniform charging was attained by selecting the distance H to be greater than 4 millimeters; even when the pitch P was 2 millimeters, uniform charging was accomplished by selecting the distance H to be greater than 7 millimeters.

Referring to FIGS. 3 to 9, modifications to the embodiment shown in FIGS. 1 and 2 are shown.

Figure 3:
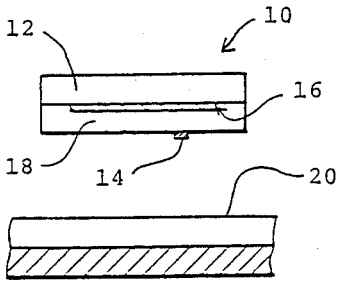
FIGS. 3, 4, 5, 6, 7 and 8 are views each showing a modification to the discharging device of FIG. 1.
Figure 4:
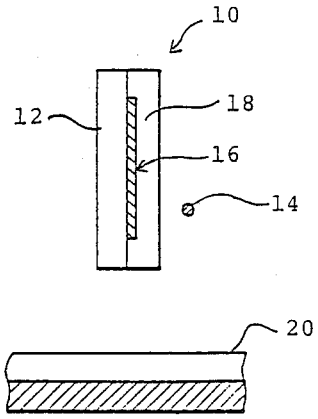

FIG. 3 shows the discharging device 10 which is positioned parallel to the photoconductive element 20. While each of the discharging devices 10 shown in FIGS. 1 to 3 has the first electrode 14 being fixed to the dielectric substrate 18, the first electrode 14 may be provided independently of the dielectric substrate 18, as shown in FIG. 4. It is to be noted that the discharging device 10 of FIG. 4 may also be positioned parallel to the photoconductive element 20 as that of FIG. 3.

Figure 5:
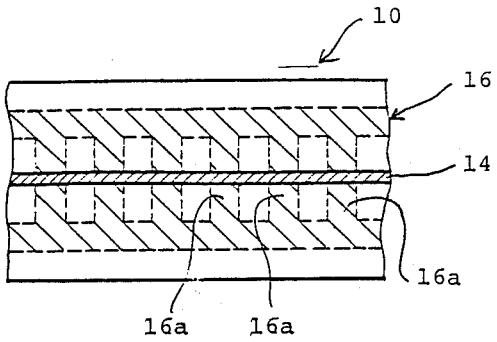
Figure 6:
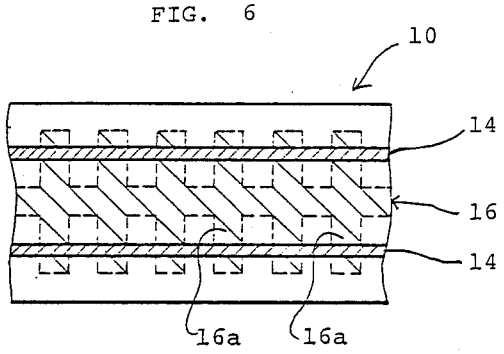
Figure 7:
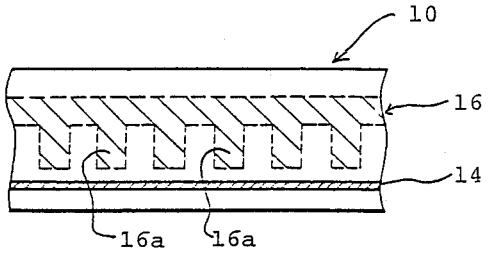
Figure 8:
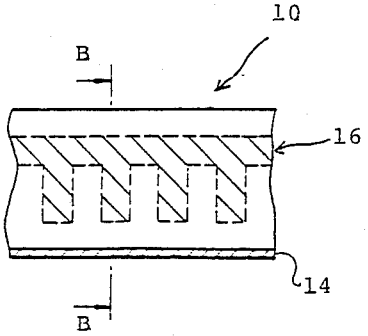
Figure 9:
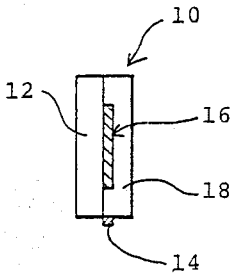
FIG. 9 is a section along line B—B of FIG. 8.

FIG. 5 shows a modification in which the conductive strips **16*a* are connected together at their two positions (opposite ends) to constitute the second electrode 16. In FIG. 6, the conductive strips 16*a* of the second electrode 16 are connected together at their intermediate portions, and two first electrodes 14 are used. In FIG. 7, the first electrode 14 is disposed outward of the second electrode 16. Further, in FIG. 8, the first electrode 14 is provided on that end of the discharging device 10 which extends in the longitudinal direction of the device 10. FIG. 9 is a section along B—B of FIG. 8**.

In any of the modifications shown in FIG. 5 to 9, the first electrode 14 may be fixed to or stretched independently of the dielectric substrate 18 as desired.

As described above, each of the discharging devices 10 shown in FIGS. 1 to 9 implements the second electrode 16 with a plurality of comblike conductive strips **16*a*. Such a configuration renders some uneven distribution of capacitance between the conductive strips 16*a* and the first electrode 14 negligible. Further, the discharge start voltage at the ends of the conductive strips 16*a* is lowered due to a fringing effect. These, coupled with the fact that a number of discharge start points are arranged along the length of the second electrode 16**, insure uniform charging and discharging even if the ac voltage is low.

Figure 10:
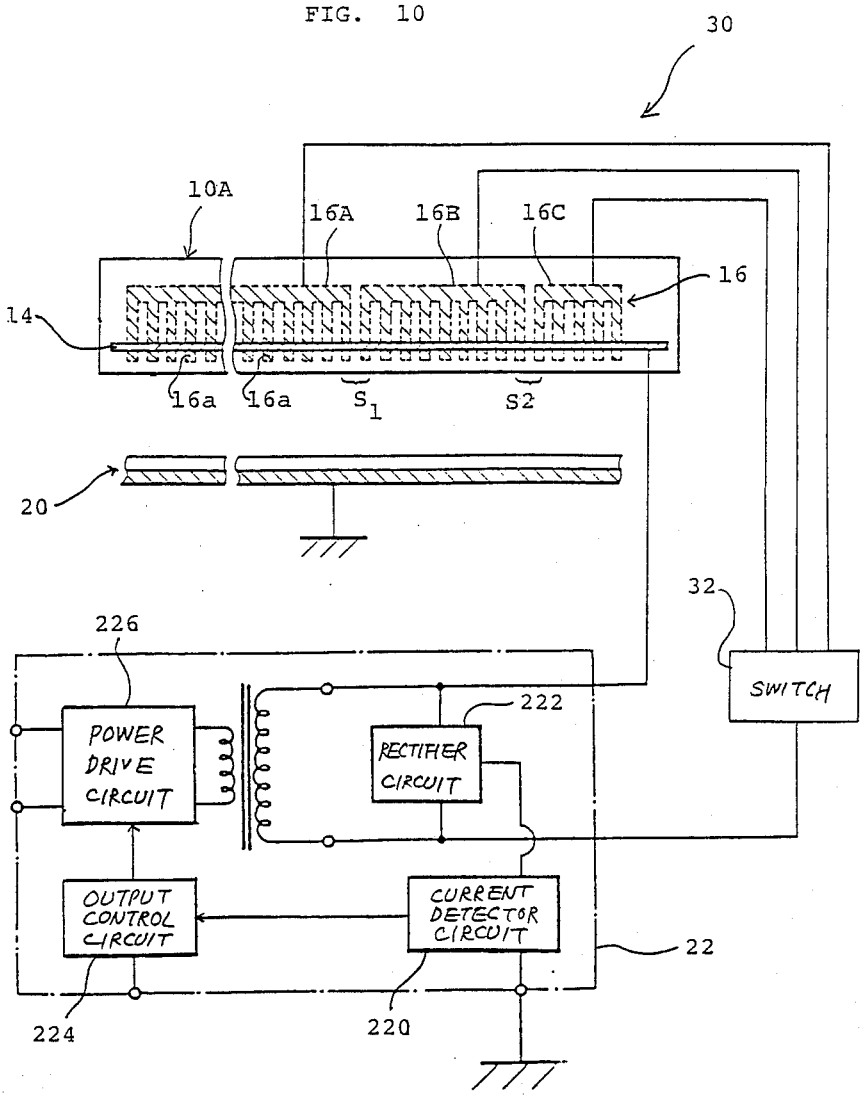
FIG. 10 is a schematic block diagram showing a system which is capable of selectively charging or discharging different areas of an object by use of any of the embodiments and its modifications shown in FIGS. 1 to 9.

Referring to FIG. 10, there is shown a system capable of charging or discharging only a desired area of, for example, the surface of a photoconductive element of an electrophotographic copier by use of the constructions as shown in FIG. 1. In the figure, the same structural elements as those shown in FIG. 1 are designated by like reference numerals. The system, generally 30, includes a discharging device 10A made up of the first electrode 16 which is implemented with a hairline type electrode, and the second electrode 16 which is divided into three discrete segments 16A, 16B and 16C. The first electrode 16 has a length which is greater than the maximum charging width of the photoconductive element 20. The segment 16A of the second electrode 16 is adapted to charge the minimum charging area on the photoconductive element 20 which corresponds to paper sheets of minimum size. The segment 16B is adapted to charge, in cooperation with the segment 16A, the charging area on the element 20 which corresponds to paper sheets of another size which is greater than the minimum size. Further, the segment 16C is adapted to charge, in cooperation with the segments 16A and 16B, the charging area on the element 20 which corresponds to paper sheets of further greater size. The gap $S_1$ between the segments 16A and 16B and the gap $S_2$ between the segments 16B and 16C are each dimensioned equal to the distance d, FIG. 1, between the nearby conductive strips **16*a*. Because the first electrode 14 is implemented with a hairline which has no joints and extends beyond the maximum charging width of the photoconductive element 20**, the irregularity in charging potential at joints is negligible in practice.

As regards the charge potential, a constant voltage power source may preferably be used to maintain it constant. Specifically, such a power source would allow the current to be automatically controlled in response to any change in load due to a change in the charging area. However, with a constant current power source with a capability of compensating for a change in charge current due to a change in circumferential condition, it is impossible to control the charge current while charging is under way. In the system 30, the power source 22 is constructed such that a charge current flowing from the discharging device 10A to the photoconductive element 20 is routed to a rectifier circuit 222 via ground and a current detector circuit 220, the circuits 222 and 220 being built in the power source 22. The current detector circuit 220 produces an output which is a voltage corresponding to the charge current, the detector output being applied to an output control circuit 224. In response, the output control circuit 224 determines whether or not the detector output is equal to a predetermined reference value. The output of the output control circuit 224 is fed to a power driver circuit 226 to control the amount of current application. By manipulating the ac voltage applied across the first and second electrodes 14 and 16, the dc bias, too, is changed by the rectifier circuit 222. In this manner, the charge current is accurately maintained at a predetermined value.

When a switch 32 is operated to connect the second electrode 16 to the power source 22 in matching relation to a desired chargin area of the photoconductive element 20, the set value of charge current is changed by the current detector circuit 220 or the output control circuit 224 based on the number of the segments 16A to 16C connected. Consequently, the value of charge current per unit length is maintained constant in the desired charging area.

It is to be noted that the three segments of the second electrode 16 shown in FIG. 10 are only illustrative and may be replaced with two or more than three segments. If desired, the conductive strips **16*a*** may be connected to a power source independently of each other. In an image-forming system of the type having a reference position at the center, segment electrodes will be provided at both end portions.

Further, the system 30 of FIG. 10 may be implemented with any of the other discharging devices 10 as shown in FIGS. 3 to 8. In any of such alternative cases, the second electrode 16 will be segmented based on the predetermined charging areas on the photoconductive element 20, and the segments will be selectively connected to the power source 22 through the switch 32.

In summary, it will be seen that a flat solid discharging device of the present invention uniformly charges or discharges a desired object without resorting to an increase in the ac voltage applied across a first and a second electrode.

In addition, the discharging in accordance with the present invention is capable of selectively charging or discharging only a limited area of a desired object.

Various modifications will become possible for those skilled in the art after receiving the teachings of the present disclosure without departing from the scope thereof.

What is claimed is:

1. A flat solid discharging device comprising:

a dielectric substrate substantially rectangular in shape;

a thin hairline type first electrode placed on one side of said dielectric substrate extending along the length of said discharging device;

a second electrode placed directly on the other side of said dielectric substrate to face said first electrode through said dielectric substrate; and a means for applying an ac voltage across said first and second electrodes to produce ions in a space adjacent to said first electrode;

wherein said second electrode comprises a plurality of comblike conductive strips having spaces therebetween each extending crosswise relative to the length of said first electrode through said dielectric substrate.

2. A discharging device as claimed in claim 1, further comprising an insulative substrate placed on the other side of said second electrode so as to place said second electrode between said insulative substrate and said dielectric substrate.

3. A discharging device as claimed in claim 1, wherein said conductive strips of said second electrode are arranged at a pitch ranging from 0.3 millimeter to 3 millimeter.

4. A discharging device as claimed in claim 1, wherein each of said first and second electrodes is formed on a respective one of opposite surfaces of said dielectric substrate by printing a conductive layer.

5. A discharging device as claimed in claim 1, wherein said first electrode makes contact with the surface of said dielectric substrate.

6. A discharging device as claimed in claim 1, wherein said first electrode is spaced from the surface of said dielectric substrate.

7. A discharging device as claimed in claim 1, wherein said conductive strips of said second electrode are divided into a plurality of segments.

8. A discharging device as claimed in claim 7, further comprising a switch connected between said ac applying means and said second electrode for causing said ac applying meand to selectively applying said ac voltage to said segments.

9. A discharging device as claimed in claim 1, wherein said ac applying means comprises:

a constant voltage power source.

10. A discharging device as claimed in claim 1, wherein said ac applying means comprises:

a constant current power source.

11. A discharging device as claimed in claim 1, wherein said first electrode comprises an electrode which has no joints and has a length greater than a maximum charging width of a desired object.

* * * * *